US006401372B1

(12) United States Patent
Kovner

(10) Patent No.: US 6,401,372 B1
(45) Date of Patent: Jun. 11, 2002

(54) BUSINESS CARD HOLDER AND STORAGE AND RETRIEVAL SYSTEM AND METHOD

(76) Inventor: Spencer Kovner, 317 N. Soto St., #6, Los Angeles, CA (US) 90033

( * ) Notice: Subject to any disclaimer, the term of this patent is extended or adjusted under 35 U.S.C. 154(b) by 0 days.

(21) Appl. No.: 08/469,065

(22) Filed: Jun. 5, 1995

Related U.S. Application Data

(63) Continuation-in-part of application No. 08/362,573, filed on Jul. 13, 1994, now Pat. No. 5,572,815, which is a continuation-in-part of application No. PCT/US93/00772, filed on Jan. 15, 1993, which is a continuation-in-part of application No. 07/577,332, filed on Aug. 31, 1990, now abandoned.

(51) Int. Cl.[7] ..... B42F 3/00
(52) U.S. Cl. ..... 40/404; 40/405; 402/79
(58) Field of Search ..... 40/360, 391, 395, 40/401, 404, 405, 537, 377, 388, 371, 373, 374, 375, 376, 390; 402/79; 281/2, 5; D19/76; 312/189, 193; 206/425

(56) References Cited

U.S. PATENT DOCUMENTS

| | | | | | |
|---|---|---|---|---|---|
| 42,260 | A | * | 4/1864 | Roberts | 40/537 X |
| 1,867,218 | A | * | 7/1932 | Hanson | 402/2 |
| 2,503,611 | A | * | 4/1950 | Bruen | 312/189 X |
| 2,637,325 | A | * | 5/1953 | McCabe | 40/537 |
| 3,496,665 | A | * | 2/1970 | Goldman | 40/591 |
| D310,098 | S | * | 8/1990 | Ristuccia, Sr. | D19/1 |
| 4,949,484 | A | * | 8/1990 | Finger | 40/360 X |

* cited by examiner

*Primary Examiner*—Brian K. Green
(74) *Attorney, Agent, or Firm*—John J. Connors; Connors & Associates

(57) ABSTRACT

Disclosed is a holder for business cards with a rectangular area having holes at its corners into which the corner of a business card are inserted.

4 Claims, 13 Drawing Sheets

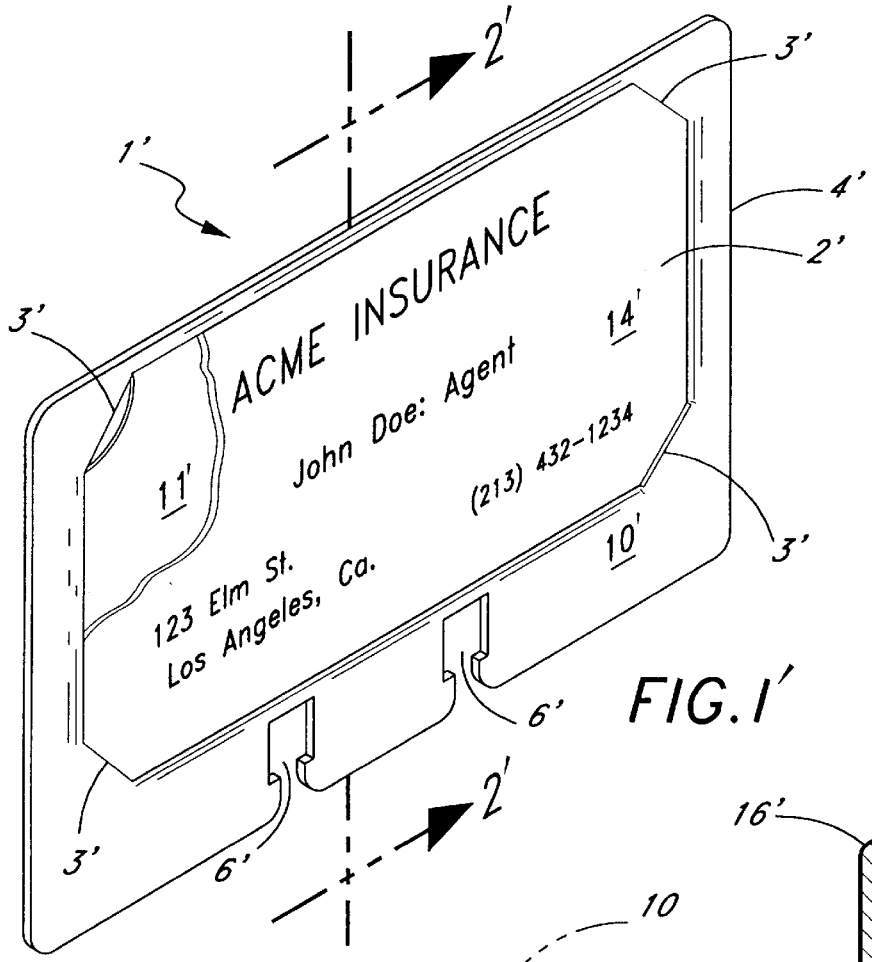
FIG. 1'
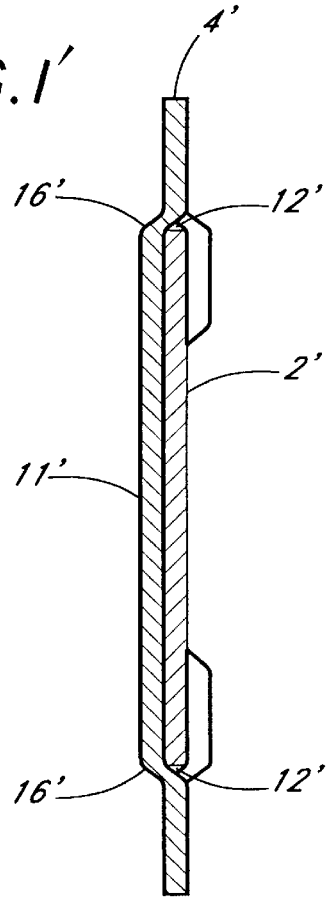
FIG. 2'
FIG. 18
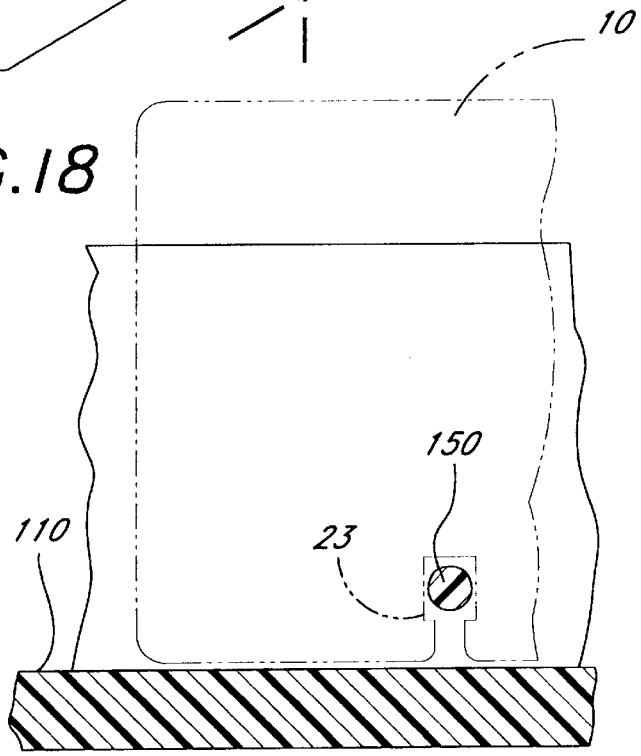

54
54a
54b
57
9B
9C
10A
10B
12a
30
56
58
60
62

79
80
84
46
86
82
30
23
12a
26
28
14
14
84
80
30
82
82

BUSINESS CARD HOLDER AND STORAGE AND RETRIEVAL SYSTEM AND METHOD

RELATED PATENT APPLICATIONS

This patent application is a continuation-in-part of U.S. patent application Ser. No. 08/362,573, filed Jul. 13, 1994, now U.S. Pat. No. 5,572,815 which is a CIP of PCT/US93/00772, filed Jan. 15, 1993, claiming the international priority date of Jan. 17, 1992, the filing date of U.S. patent application Ser. No. 07/822,401, now abandoned, which is a continuation-in-part of U.S. patent application Ser. No. 07/577,332 filed Aug. 31, 1990, now abandoned, and entitled Business Card Holder. All of these prior patent applications are incorporated herein by reference and made part of this patent application.

BACKGROUND OF THE INVENTION

1. Field of the Invention

This invention relates to a business card holder for organizing and storing business cards in a storage and retrieval system.

2. Background Discussion

Business card holders for use in standard storage and retrieval systems are well known. One commercial version comprises a transparent, rectangular plastic sleeve or envelope with opposed open ends through which a business card is inserted into the interior of the envelope. The bottom edge of the plastic envelope has mounting cutouts that enable the envelope to be removably attached to guide rails of a card storage and retrieval system. With the envelopes arranged in alphabetical order, the guide rails maintain this alphabetical organization. Such plastic envelope business card holders are difficult to manipulate, and it is awkward to insert or remove the business card from such plastic envelopes. Nor can the plastic be easily written or printed upon, for example, for advertising or color coding purposes. Rolodex Corporation makes such a business card holder.

The plastic envelope business card holder was developed because a standard paper file card with mounting cutouts along its bottom edge was not particularly suited to allow a business card to be easily mounted thereon and later removed, if desired. Many people nevertheless still use paper file cards for this purpose by simply stapling or taping a business card to the paper file card and then placing this assembly in a storage and retrieval system. This practice results in a clutter looking arrangement of business cards in the conventional storage and retrieval system, and the business cards are frequently damaged. Moreover, once attached to a paper file card in this manner, it is inconvenient to remove the business card.

Conventional storage and retrieval systems for business card holders are ordinarily injection molded plastic and frequently have the guide rails exposed to view. Such plastic storage and retrieval systems are not accepted by many users who desire a mounting device which has an appearance similar to wood office furniture. Without mounting the business card on a holder, some users simply store business cards in an attractive wooden box that is displayed on their desk tops or credenzas. Such wooden boxes, however, lack the guide rails for business card holders. It would be highly desirable to provide an attractive wooden box with guide rails for business card holders displaying business cards that are stored and organized alphabetically. The problem is that such wooden boxes with guide rails are expensive to manufacture.

SUMMARY OF THE INVENTION

The ideal card holder would be simple and inexpensive to manufacture at high volumes of production, be readily printed upon, and be easy to use. The card holder of this invention provides such advantages and has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include low cost, high volume manufacture with the ability to be printed upon during production, convenience and ease of use, and the capacity to hold business cards of various sizes.

The first feature of this invention is that it removably holds a single business card within a card storage and retrieval system. The business card holder of this invention has this capability because of its unique structure which captures and holds the business card. This structure includes a thin, but stiff, rectangular sheet with openings positioned to allow a business card to be removably attached to the holder by inserting the corners of the business card in the openings. There is at least one, preferably two, standard mounting cutouts along the lower edge of the holder for attaching the card holder to the guide rails of the storage and retrieval system.

The second feature of this invention is that the holder has an outer longitudinal top edge, a pair of opposed outer side edges, and a outer bottom longitudinal edge of standard dimensions which enable the card holder of this invention to be mounted in standard card storage and retrieval systems,. Specifically, the holder has a width of 4 inches and a height between 2.5 and 2.70 inches. This provides the card holder with outside dimensions greater than the, dimensions of the vast majority of business cards presently in use, yet enables it to be attached to a standard storage and retrieval system.

The third feature of this invention is that the sheet has a planar surface, a rectangular area displaced parallel to the planar surface a distance approximately equal to the thickness of the business card, and a marginal frame surrounding the rectangular area. The rectangular area has dimensions corresponding to the dimensions of a standard business card. The distance between the outer longitudinal edge and the displaced rectangular area is from 3/32 to 1/8 of an inch, the distance between each of the outer side edges and the displaced rectangular area is from 1/8 to 7/16 inch, and the distance between the outer longitudinal bottom edge and the displaced rectangular area is between 1/2 and 5/8 inch.

The fourth feature of this invention is that a hole is at each corner of the rectangular area. By inserting one corner of the business card into each hole, the business card is held generally within the rectangular area with a printed surface of the business card lying approximately in the planar surface and facing outward. Each hole is formed by a straight cut in the sheet oriented at approximately 45 degrees to a side edge. A portion of the rectangular area adjacent the cut is removed to allow the corners of the business card to be more easily inserted into the holes. Preferably, each hole is in the form of a segment of a circle.

The fifth, and optimal, feature of this invention is that the holder is designed to accommodate business cards of different sizes. To achieve this there are slits extending from the holes. This enables the card holder to receive business cards of different sizes. If the business card is larger than the standard size, its edges are slipped into the slits. Preferably, there are one or more slits at each hole to accommodate business cards having dimensions greater than the dimensions of a standard business card. Specifically, there is a first slit which parallels an adjacent side edge of the sheet and extends from the cut a distance of from 1/16 to 3/16 inch and terminates at a second slit. The second slit extends from the end of the first slit at an angle of from 40 to 50 degrees outward towards the adjacent side edge. The second slit has a length of an 1/16 to 3/16 inch. The holes adjacent the bottom longitudinal edge of the sheet each have a third slit which parallels the bottom longitudinal edge and extends a distance of from 1/16 to 3/16 inch from the end of the cut and terminates at a forth slit. The forth slit extends from the end of the third slit at an angle of from 40 to 50 degrees outward towards the bottom longitudinal edge a distance of from 1/16 to 3/16 inch. The first and third slits extend along the perimeter of the displaced rectangular area.

The sixth feature is that the business card holder is manufacture from a continuous web of sheet material using a rotary die to form the holder by continuously feeding the sheet material through the die. The rotary die has a first stage where the corners holes are formed, a second stage where the sheet material is debossed to form the displaced rectangular area, and a third stage where the outer perimeter of the holder sheet is formed. The corner holes are formed by cutting through the sheet which produces waste material, and the waste material may be removed using a vacuum die or a pressure die. The pressure die simply applies a stream of high velocity air against a cut segment corresponding to the hole to blow this cut segment away from the body of the sheet material. Optionally, the marginal frame surrounding the rectangular area is printed upon during manufacture of the holder.

This invention also includes a novel card storage and retrieval system, a novel three stage rotary die for making the business card holder, a method for storing and retrieving business cards using the the business card holder, and a process for making the business card holder.

The method for storing and retrieving business cards, comprising the steps of:

(a) providing a card storage and retrieval system including a mounting device with at least one guide rail to which a business card holder is removably attached, (b) providing a business card holder for mounting thereon a single business card, said business card holder comprising a thin, generally rectangular sheet having outside dimensions greater than the business card, a rectangular area on the sheet having dimensions corresponding to the dimensions of the business card and defining the location where the business card is to be held on the sheet, said area having at each corner a hole for inserting one corner of the business card;

said rectangular area being displaced inward parallel to the surface of the sheet by an amount approximately equal to the thickness of the business card;

a marginal frame surrounding said rectangular area; and at least one mounting cutout in the thin sheet for attaching the card holder to the guide rail of the card storage and retrieval system, (c) removably mounting the business card to the business card holder by inserting each corner of the business card in one of the holes in the holder to position the business card within the displaced rectangular area, and (d) attaching the assembly of the business card and holder to the guide rail by aligning the mounting cutout with the rail pushing the holder against the rail.

The process for making the business card holder includes the steps of (a) continually advancing sheet material along a predetermined path first past a station at which the holes are formed, (b) next continually advancing sheet material exiting the first station from along a predetermined path to a second station at which the displaced rectangular area is formed with the holes in the corners of the rectangular area, (c) lastly continually advancing sheet material exiting the second station from along a predetermined path to a third station at which bordering sheet material is severed from the sheet material to form said holder, including at least one mounting cutout for attaching the card holder to a guide rail of the card storage and retrieval system.

DESCRIPTION OF THE DRAWING

The preferred embodiment of this invention, illustrating all its features, will now be discussed in detail. This embodiment depicts the novel and, non-obvious card holder and method of use of this invention shown in the accompanying drawing, which is for illustrative purposes only. This drawing includes the following figures (FIGS.), with like numerals indicating like parts:

FIG. 1 is a perspective view of the card holder of this invention.

FIG. 2 is a front elevational view of the card holder of this invention.

FIG. 3 is a right side edge view of the card holder of this invention.

FIG. 4 is a top edge view of the card holder of this invention.

FIG. 5 is a bottom edge view of the card holder of this invention.

FIG. 18 is a cross-sectional view similar to that shown in FIG. 17 depicting the use of a dowl rod as a guide rail.

DESCRIPTION OF THE PREFERRED EMBODIMENTS

First Embodiment

Reference: Portions of the invention described herein were previously described in a U.S. patent application, Ser. No. 07/288,561. filed on Dec. 19, 1988 by the same applicant as the current applicant. said application was allowed to default to abandonment.

Figure 5:
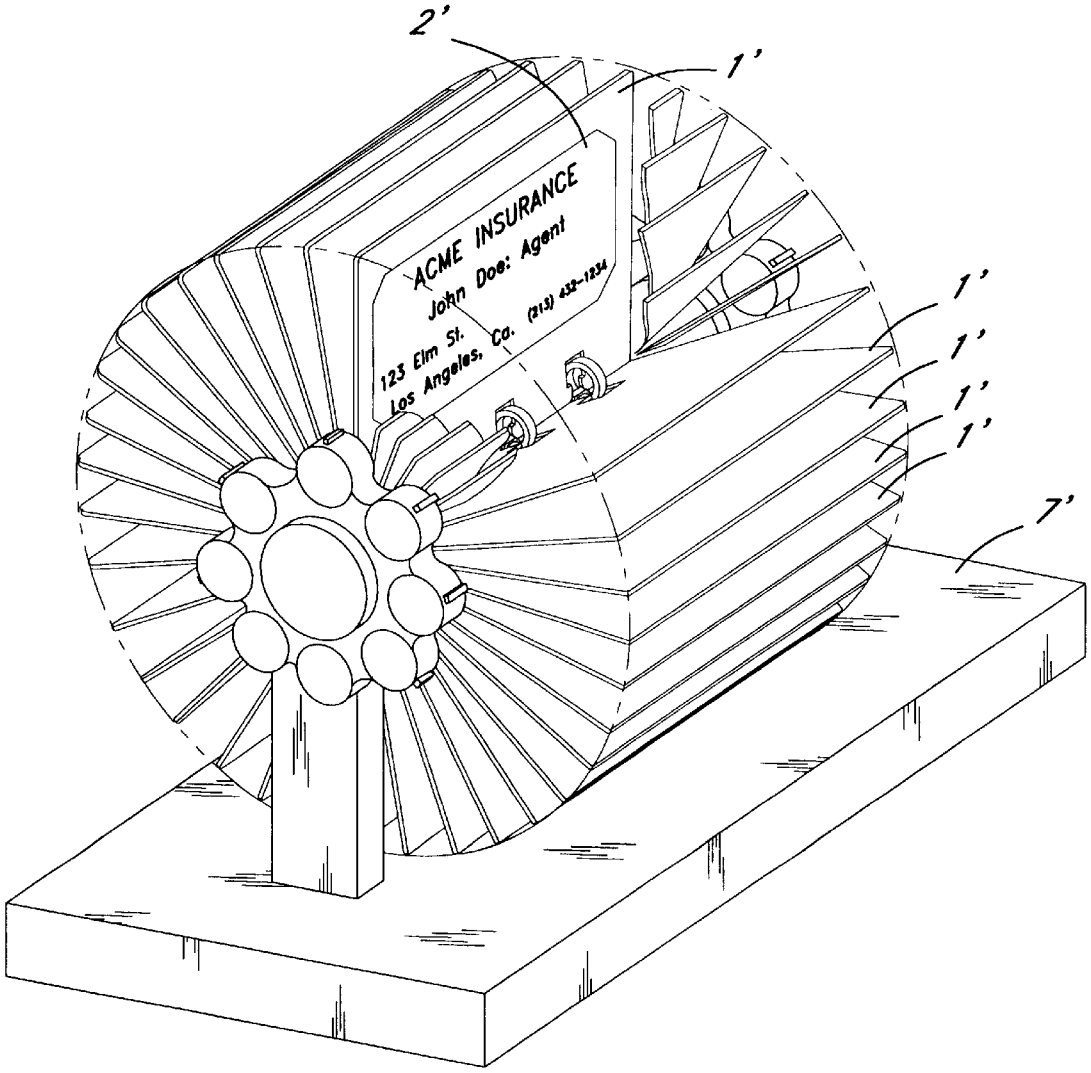
FIG. 5' is a perspective view of a typical card file storage apparatus with a plurality of the invention mounted therein.
Figure 1A:
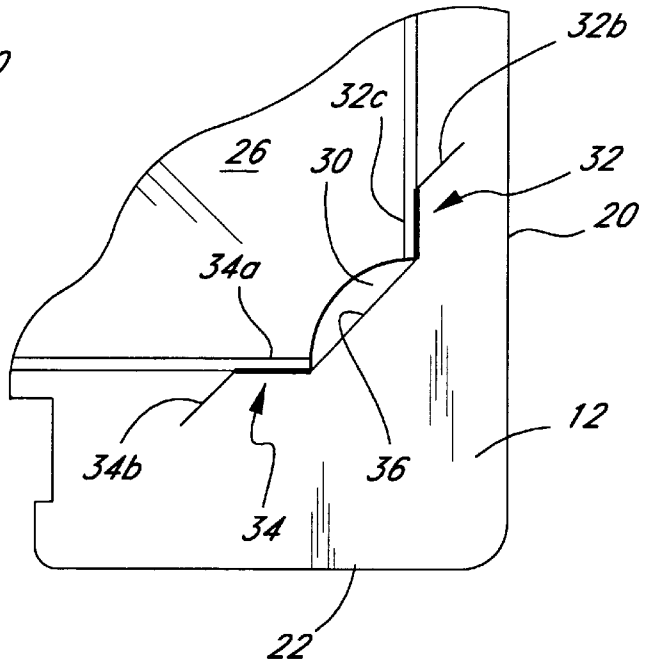
FIG. 1A is an enlarged, fragmentary view of a corner of the card holder of this invention.
Figure 1:
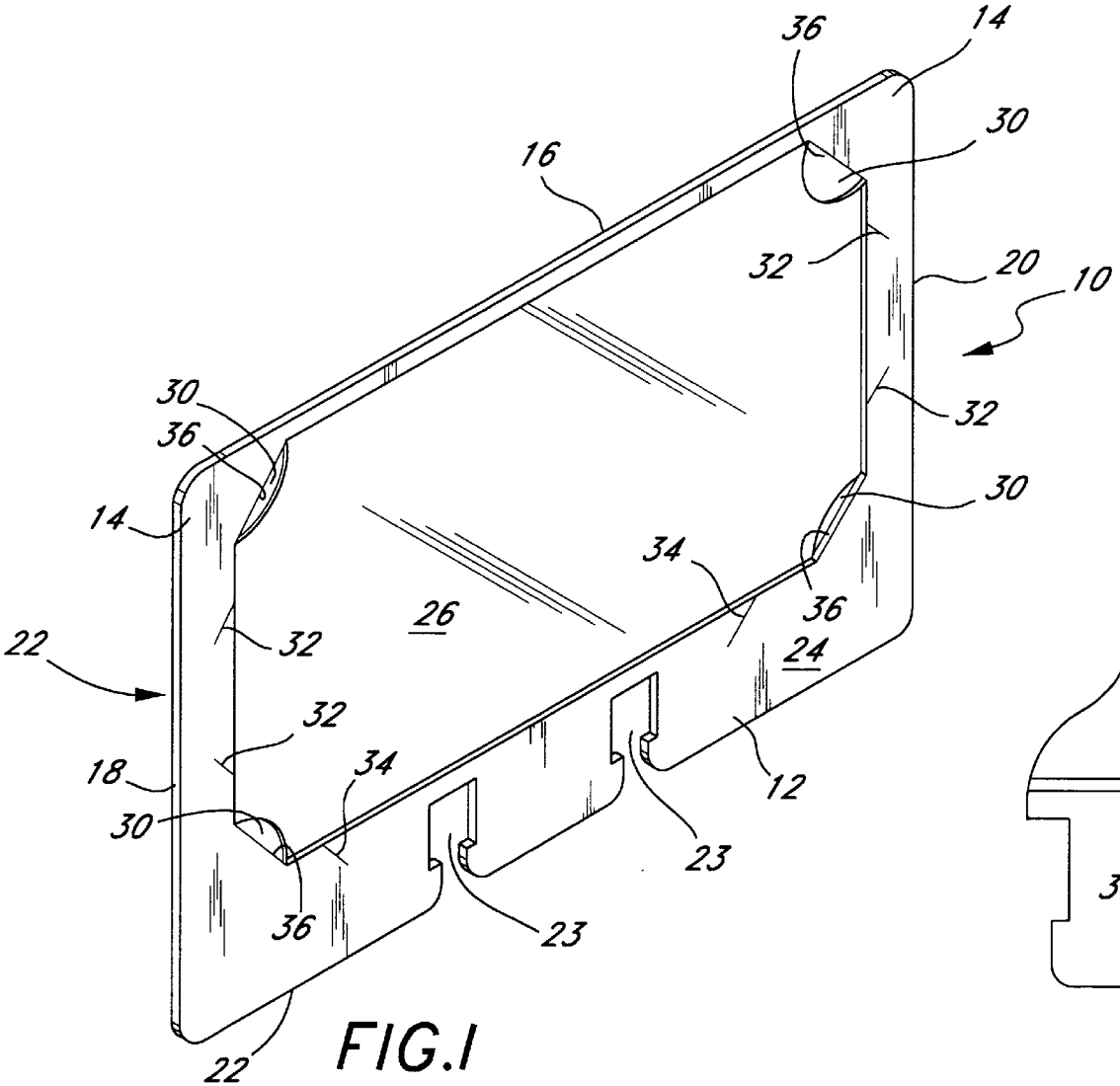
FIG. 1' is a perspective drawing showing a business card mounted in the invention.
Figure 3:
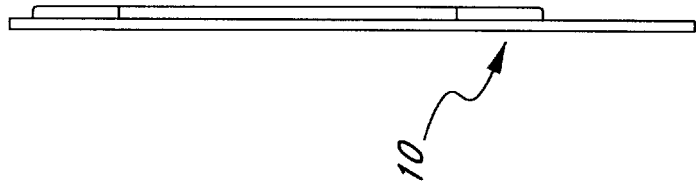
Figure 2:
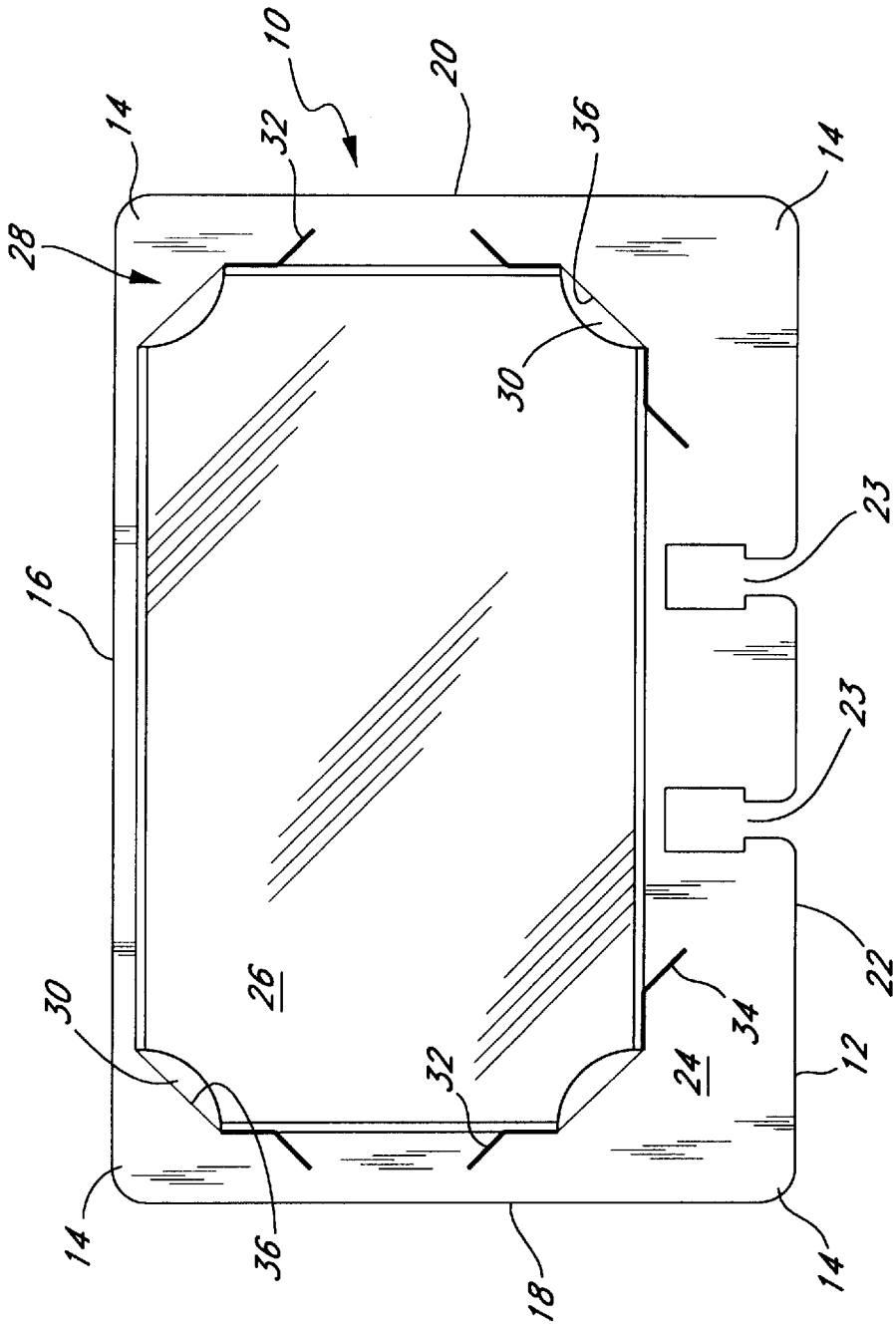
FIG. 2' is a cross sectional view of FIG. 1 taken along line 2'—2' showing further details of the debossed area of the invention, the location of the business card and the means of attachment of the business card to the invention.
Figure 4:
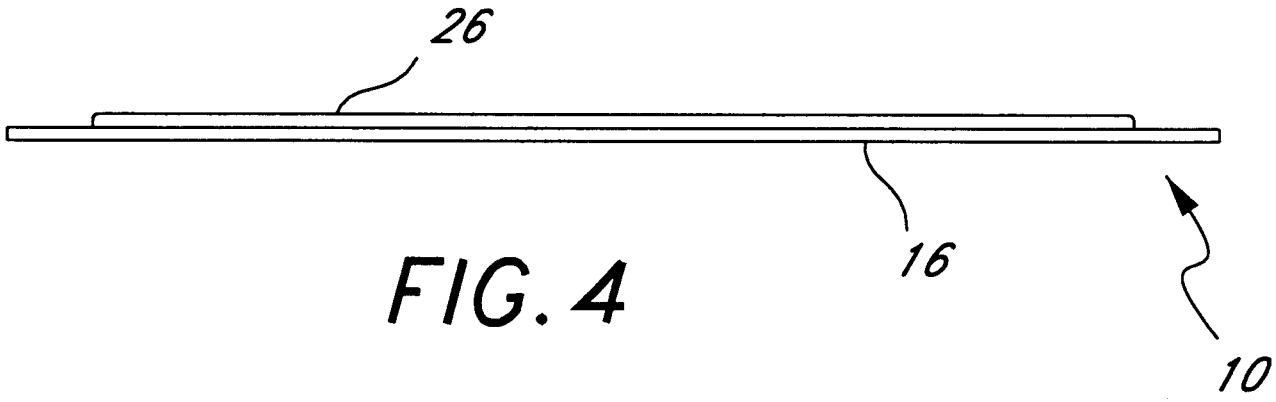
Figure 5:
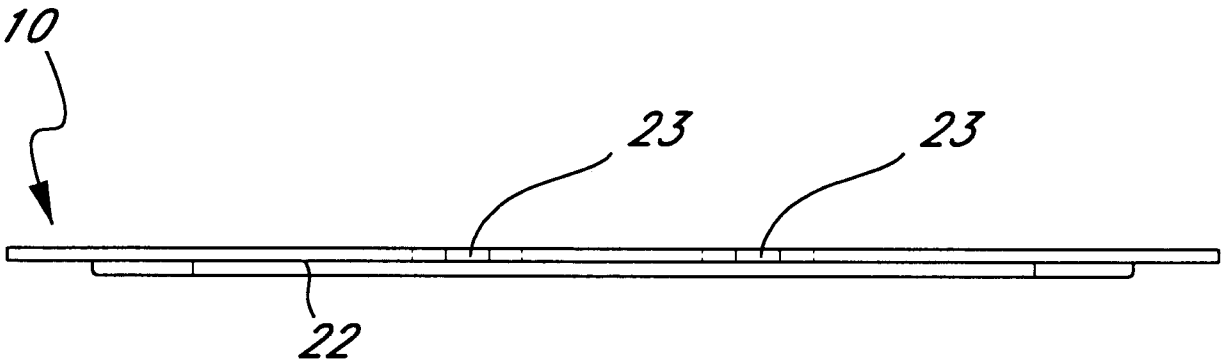
Figure 6:
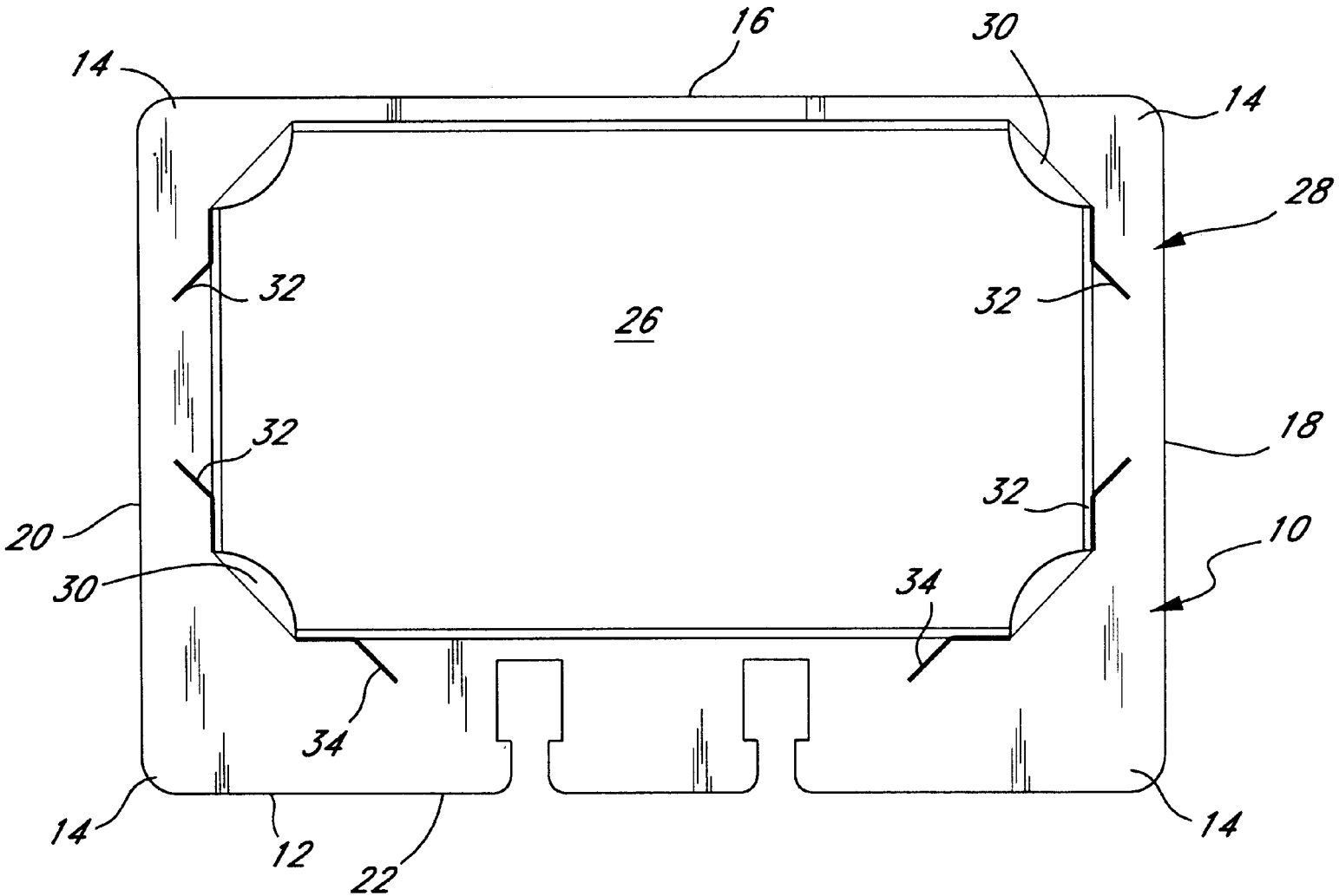
FIG. 6 is a rear elevational view of the card holder of this invention.

FIGS. 1' and 2' show a business card holder 1' for mounting a standard business card 2' within a card filing and storage apparatus 7', shown in FIG. 5'. The card holder 1' comprises a thin sheet 4' of either stiff paper or plastic material defining a first plane surface 10'. the thin sheet 4' having outside dimensions greater than the business card 2'. A rectangular area 11' in the thin sheet 4' is formed so as to be displaced parallel to the first plane surface 10' by an amount approximately equal to the thickness of the business card 2'. Referring to FIG. 1' and FIGS. 3' and 4', each corner 3' of the rectangular area 11' has a hole 12' for inserting one corner 13' of the business card 2', wherein the business card 2' is captured within the rectangular area 11' with the printed outfacing surface 14' of the business card 2' lying coincident with the first plane surface 10'.

Figure 3:
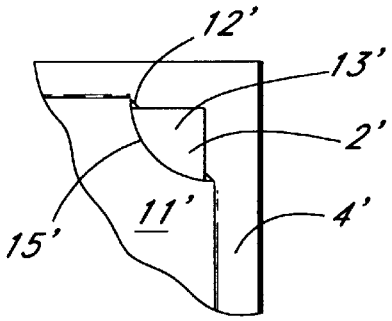
FIG. 3' is a partial rear view of the invention showing one type of corner mounting.
Figure 4:
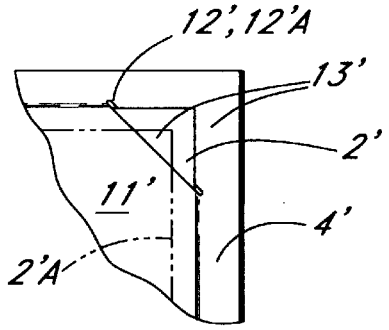
FIG. 4' is a partial rear view of the invention showing a second type of corner mounting.

In the preferred embodiment, at least one mounting cutout 6' (FIG. 1') is provided in card holder 1' for mounting same to storage apparatus 7'. FIG. 4' shows the hole 12' for inserting one corner 13' of the business card 2' is a straight cut slit 12' A oriented at 45 degrees to the edges of the rectangular area 11'. FIG. 3' shows a portion 15' of the rectangular area 11' adjacent to the straight cut slit 12' A removed to allow the business card 2' to be more easily inserted into the card holder 1'. The transition surface 16' between the thin sheet 4' and the debossed rectangular area 11' forms an inclined plane surface to the edges of the business card 2'. The transition surface 16' forms a frame surrounding business card 2' and tends to maintain business card 2' at the center of the rectangular area 11'. Therefore, business cards 2' of a range of sizes may be successfully captured by the four corners 3' of rectangular area 11'. That is to say, that, for relatively small business cards 2' A whereby only a small amount of overlap exist between the four corners 3' of the rectangular area 11' and the corners of the business card 13', the relatively small business card 2' A is effectively held since the card 2' A remains centered Within area 11' maintaining corner 13' capture.

Second Embodiment

As illustrate in FIGS. 1 through 6, the second embodiment of the card holder 10 of this invention is made from a rectangular sheet 12 of card stock paper or plastic. With paper, the thickness of the sheet 12 is from about 0.010 to about 0.012 inch. With plastic, the thickness of the sheet 12 is from about 0.005 to about 0.008 inch. Plastic is preferred because it is more durable. Mylar brand plastic is suitable.

The sheet 12 has a width of about 4 inches and a height of from about 2.5 to about 2.70 inches. Preferably, the corners 14 of the sheet 12 are rounded, and the sheet has a top longitudinal edge 16, a pair of opposed side edges 18 and 20, and a bottom longitudinal edge 22. There are adjacent, standard mounting cutouts 23 in the sheet 12 for attaching the card holder 10 to a standard card storage and retrieval system (not shown).

The sheet 12 has a planar surface 24 and a rectangular area 26 displaced parallel to the planar surface 24 a distance approximately equal to the thickness of a standard business card, or about 0.010–0.012 inch. The rectangular area 26 has dimension of about 2 inches by about 3.5 inches. Surrounding the rectangular area 26 is a marginal frame 28. The distance between the outer longitudinal edge 16 and the displaced rectangular area 26 is from about 3/32 to about 1/8 of an inch, the distance between each of the outer side edges 18 and 20 and the displaced rectangular area is from about 1/8 to about 7/16 inch, and the distance between the outer longitudinal bottom edge 22 and the displaced rectangular area is from about 1/2 to about 5/8 inch.

In accordance with this invention, the card holder 10 has a unique structure which captures and removably holds a business card (not shown). This structure comprises at each corner of the rectangular area 26 holes 30 and, optionally, slits 32 and 34 extending from the holes. The holes 30 are formed by a straight cut 36 in the sheet 12 at an angle of about 45 degrees to an edge 18 or 20, with an adjacent portion of the rectangular area 26 removed to enlarge the cut 36, forming a hole in the shape of a segmented circle. The slits 32 extend outward from an end of the cut 36 near the side edges 18 or 20, and the slits 34 extend outward from opposite ends of the cuts 36 in the holes 30 near the bottom edge 22.

As best depicted in FIG. 1A, each slit 32 has a slit portion 32*a* extending from the end of the cut 36 parallel to the side edges 18 and 20. The length of this slit portion 32*a* is about 1/16 to about 3/16 inch, and it terminates in a slit portion 32*b*. The slit portion 32*b* extends outward towards the adjacent side edge 20 or 18 as the case may be from the end of the slit portion 32*a* at an angle of from 40 to 50 degrees. This slit portion 32*b* has a length of about 1/16 to about 3/16 inch. Each slit 34 has a slit portion 34*a* extending from the end of the cut 36 parallel to the bottom edge 22. The length of the slit portion 34*a* is about 1/16 to about 3/16 inch, and it terminates at a slit portion 34*b*. The slit portion 34*b* extends from the end of the slit portion 34*a* at an angle of from 40 to 50 degrees outward towards the bottom longitudinal edge 22. It has a length of about 1/16 to about 3/16 inch. The the slit portions 32*a* and 34*a* extend along the perimeter of the displaced rectangular area 26.

Because of the unique combination of holes 30 and slits 32 and 34, the card holder 10 captures rectangular business cards varying in size over a range of: width equals 3.5 inches plus or minus ¼ inch, and height equals 2 inches plus or minus 3/16 inch. The corners of a business card are slipped into the holes 30, and for a business card larger than the standard size, its edges nearby the card's corners are slipped into the slits 32 and 34 and the card is positioned so that it overlies the rectangular area 26, with its edges slightly extending beyond the perimeter of the rectangular area. The body of the business card is cradled in the displaced rectangular area 26, and does not slip from the card holder 10. The business card is held firmly, but may be easily removed from the card holder 10.

Third Embodiment

Figures 7, 8:
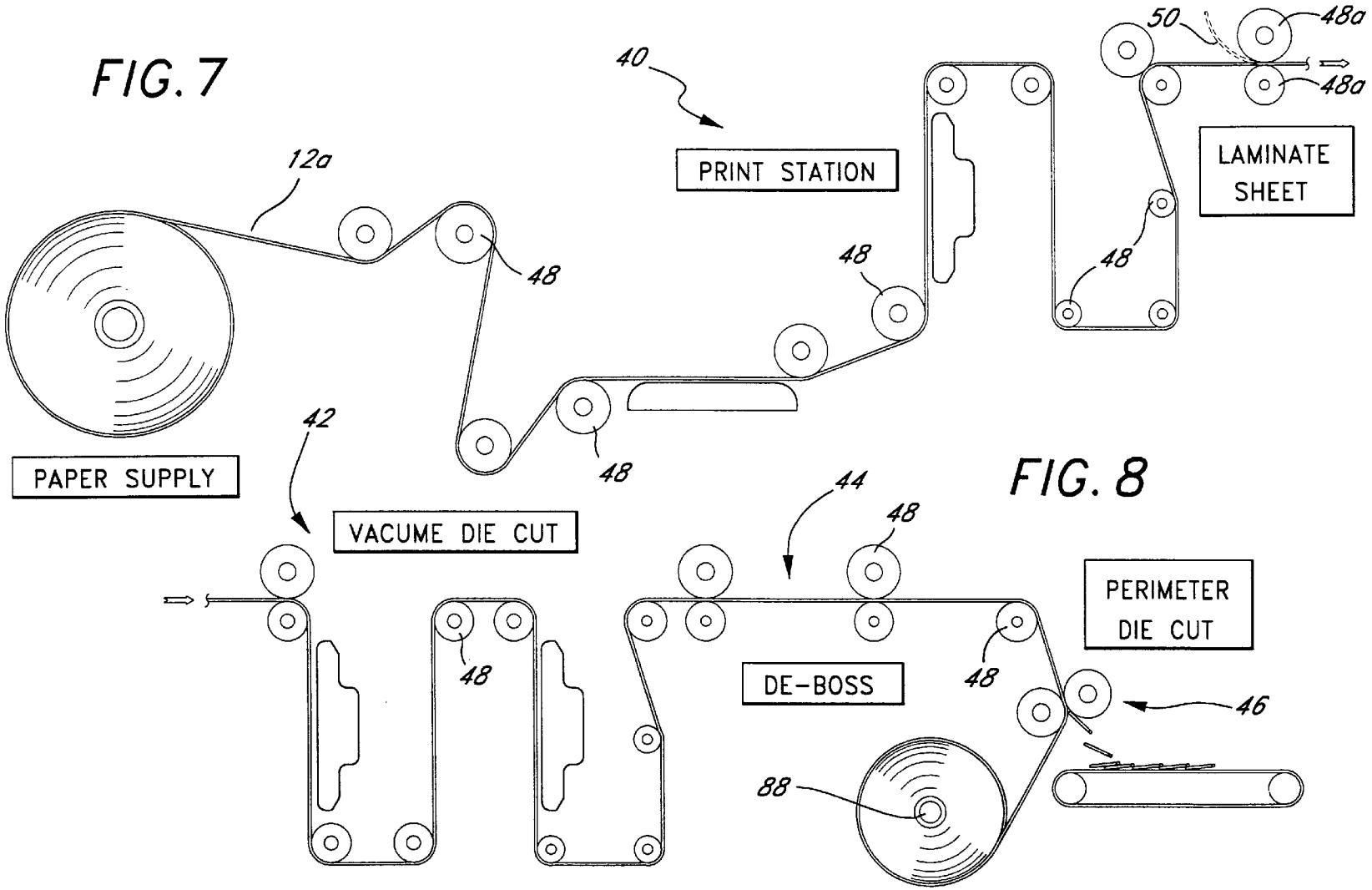
FIGS. 7 and 8 are schematic process diagrams illustrating how the business card holder of this invention is made from a continuous web of sheet material.
Figures 9A, 9B, 9C, 10A:
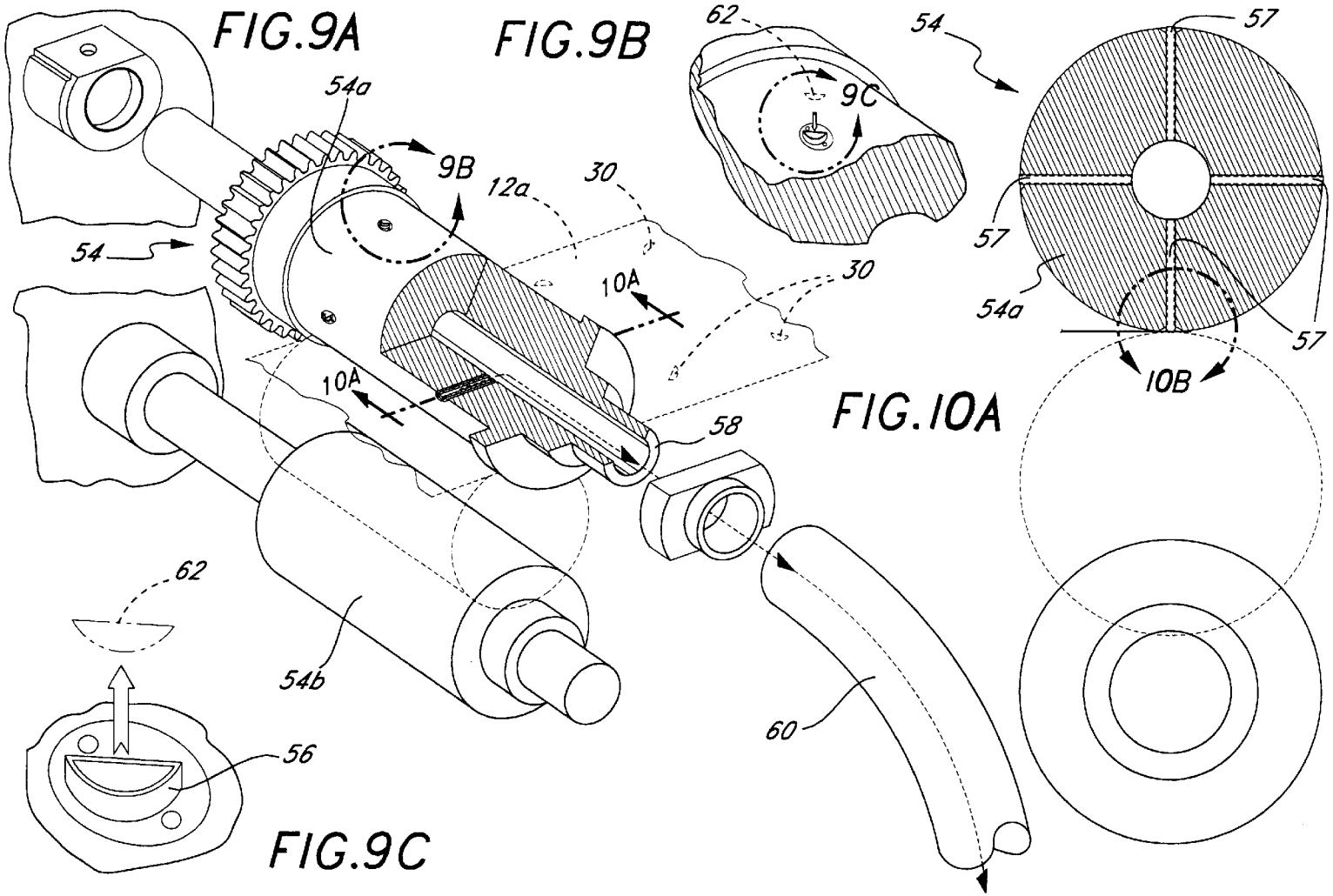
FIG. 9A is a perspective view showing the rotary die mechanism for cutting the holes in the corner of the displaced or debossed rectangular area prior to forming this displaced area.
FIG. 9B is an enlarged fragmentary view taken along line 9B of FIG. 9A.
FIG. 9C is an enlarged fragmentary view taken along line 9C of FIG. 9B.
FIG. 10A is a cross-sectional view taken along line 10A—10A along FIG. 9A.
Figure 10B:
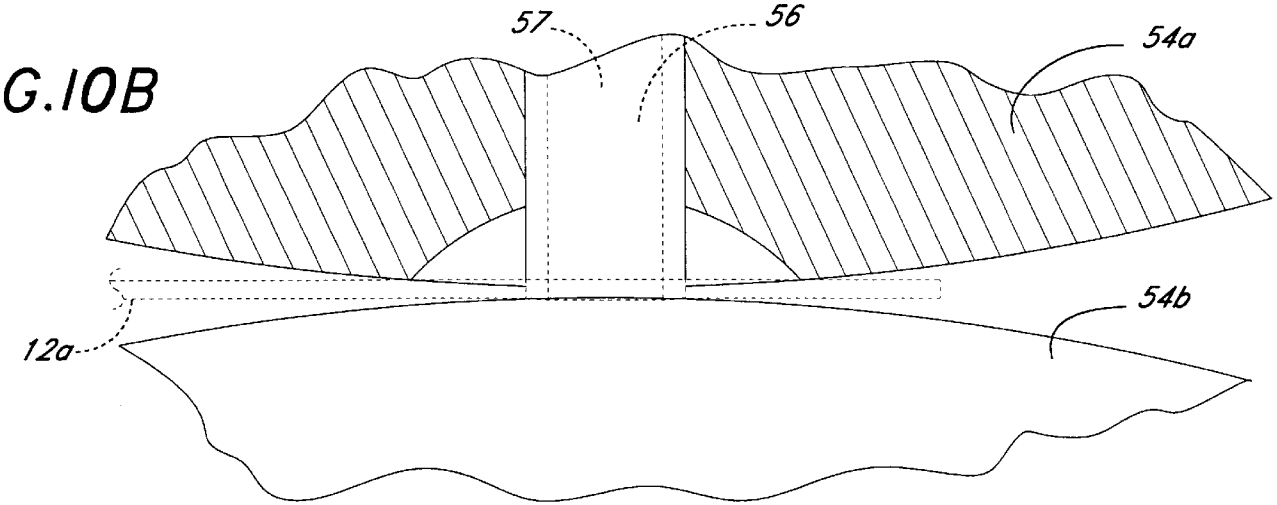
FIG. 10B is an enlarged fragmentary view taken along line 10B of FIG. 10A.

FIGS. 7 and 8 depict the process for making the business card holder 10 from a roll or web of sheet material 12*a*. The web of sheet material 12*a* is continuously fed first past a printing station 40, second past a hole forming station 42, third past a debossing station 44, and fourth past a perimeter forming station 6'. This sequence is important. The holes are formed in the flat sheet material 12*a* prior to debossing to form the displaced rectangular area 26. Trimming bordering sheet material 12*b* away from the perimeter of the holder 10 is the final step of the process. Conventional rotary dies such as, for example, manufactured by Avis Roto-Die Company, Inc. of Los Angeles, Calif. are used to form the holder 10. The use of rotary dies is the best way to form the holder 10, because they assist in advancing the sheet material 12*a* along its path of travel while simultaneously forming the holder. Moreover, the use of rotary dies facilitates rapid production of large numbers of holders 10.

In this embodiment, it is desirable, but not required, to print on the sheet material 12*a*. Consequently, the sheet material 12*a* is preferably paper. Printing is highly desirable, because it allows the holder 10 to be printed with advertisements. Moreover, the marginal frame 28 is printed With a color for coding purposes. The sheet material 12*a* is advanced continuously by a series of rollers 48 along a path past the stations 40, 42, 44 and 46. Optionally, a laminate sheet 50 may ,be fed to the rollers 48*a*. The sheet material 12*a* first goes through the printing station 40 which prints on the web.

As best shown in FIGS. 9A through 9C and FIGS. 10A and 10B, the half moon shaped holes 30 are formed using a conventional vacuum die 54 which cuts these holes and then applies a vacuum to the severed sheet. The die 54 includes a pair of rollers 54*a* and 54*b*, with the lower roller 54*b* movable into engagement (shown in phantom) With the upper roller 54*a* during operation. The upper roller 54*a* has four half moon shaped blades 56 position to correspond with the location of the holes 30 in the holder 10. The shaft 58 of the roller 54*a* and the blades 56 are both hollow, and there is a passageway 57 through the blades that is in communication with the shaft. A vacuum line 60 connected to the shaft 58 applies vacuum to the blades 56 to draw the half moon shaped, cut-a-way Waste segments 62 into the line 60, exhausting these segments. An alternate technique would be to use a two stage blower or pressure die (not shown). In this case, the blade of the first stage would cut the half moon shaped,, cut-a-way Waste segments 62 and a second stage would apply pressure downstream against the cut-a-way Waste segments, blowing them away from the body of the sheet material 12*a*.

Figure 12B:
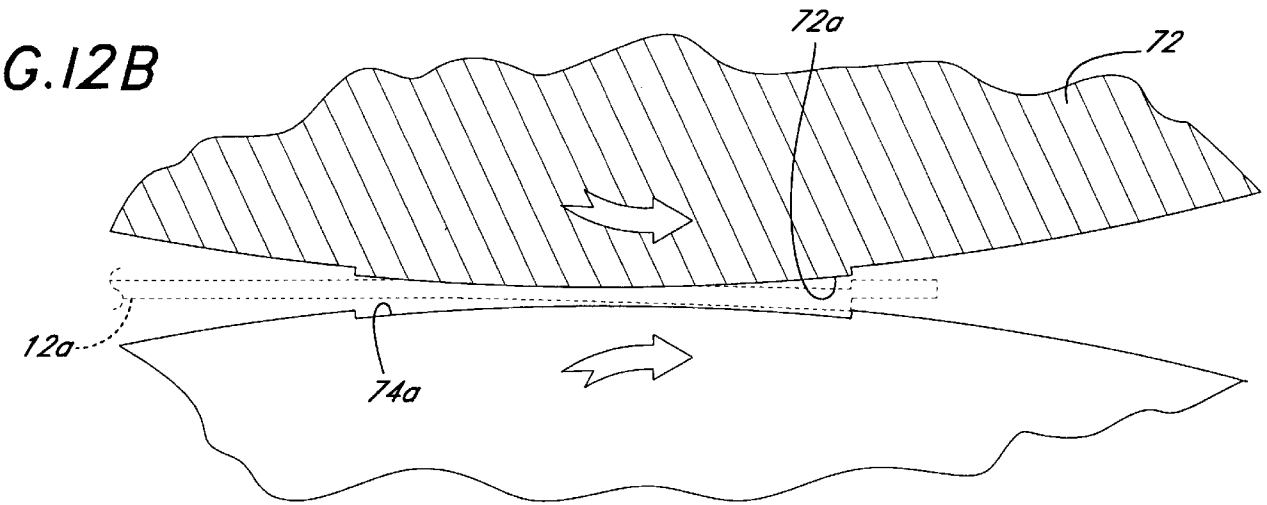
FIG. 12B is an enlarged fragmentary view taken along line 12B of FIG. 12A.
Figures 11, 12A:
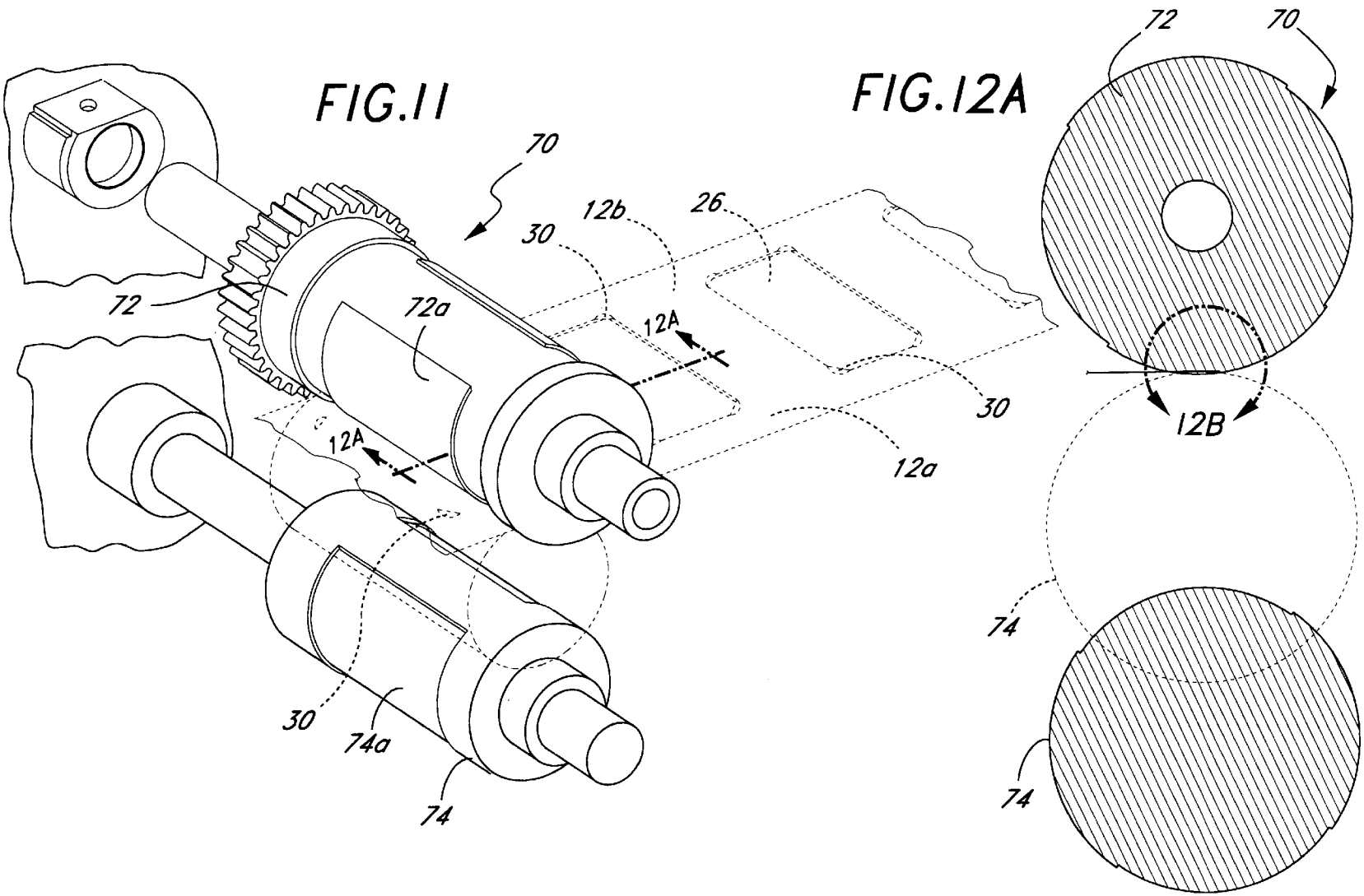
FIG. 11 is a perspective view showing the rotary die mechanism for forming the displaced rectangular area.
FIG. 12A is a cross-sectional view taken along line 12A—12A of FIG. 11.
Figures 13, 14:
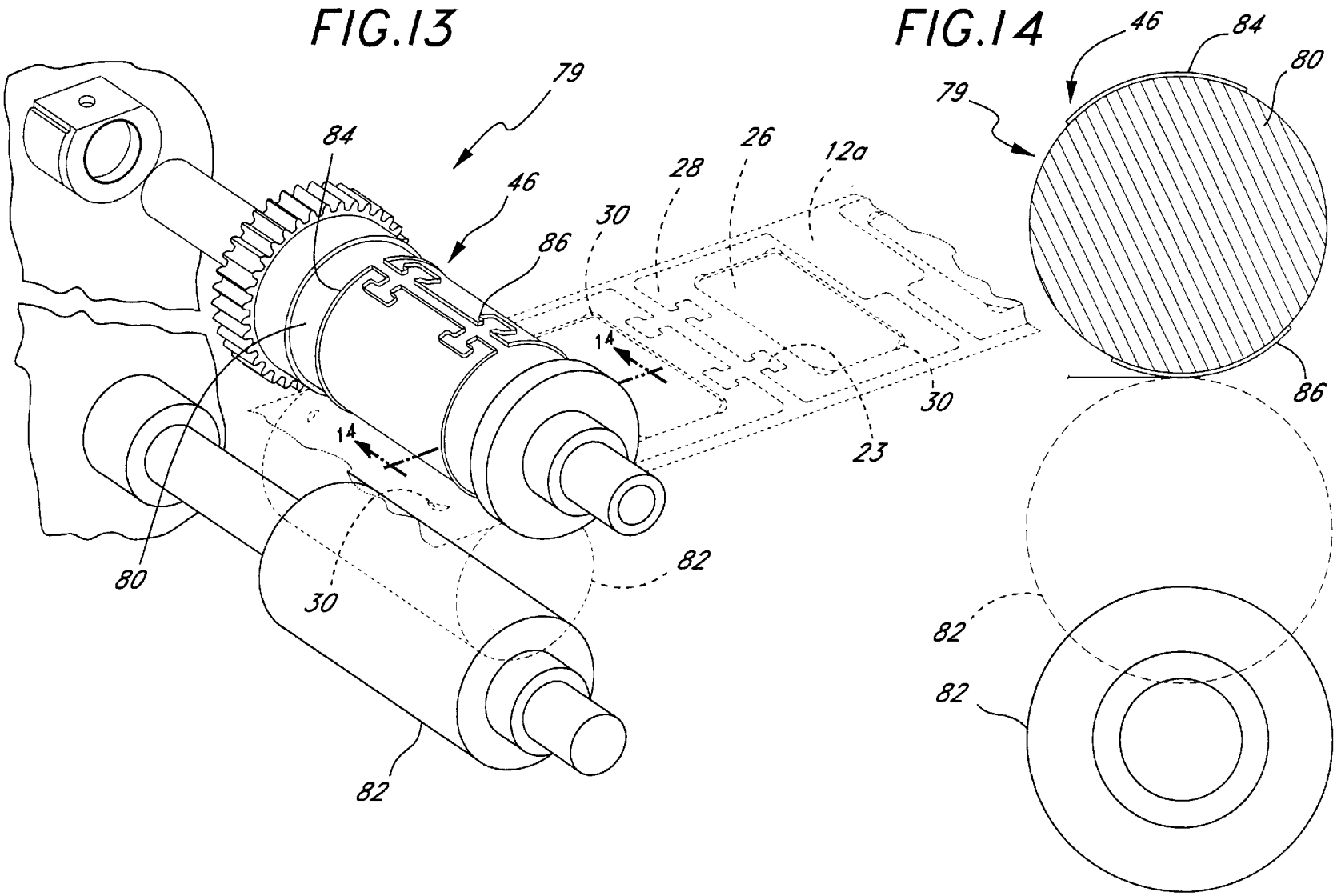
FIG. 13 is a perspective view of the rotary die mechanism used to form the perimeter of the business card holder.
FIG. 14 is a cross-sectional view taken along line 14—14 of FIG. 13.

With the holes 30 formed in the sheet material 12*a*, the sheet material is next advanced to the debossing station 44 best illustrated in FIGS. 11, 12A and 12B. A conventional rotary die 70 compresses the sheet 12*a* between a pair of rollers 72 and 74 which presses the sheet material between these rollers upon moving the lower roller 74 (shown in phantom) into engagement with the upper roller 72. The rollers 72 and 74 have mating male and female die surfaces 72*a* and 74*a*, respectively, that deform the sheet material 12*a* as the sheet material moves through the nip of the rollers. This forms the displaced rectangular area 26. Debossing is conducted subsequent to the formation of the holes 30.

Figure 16:
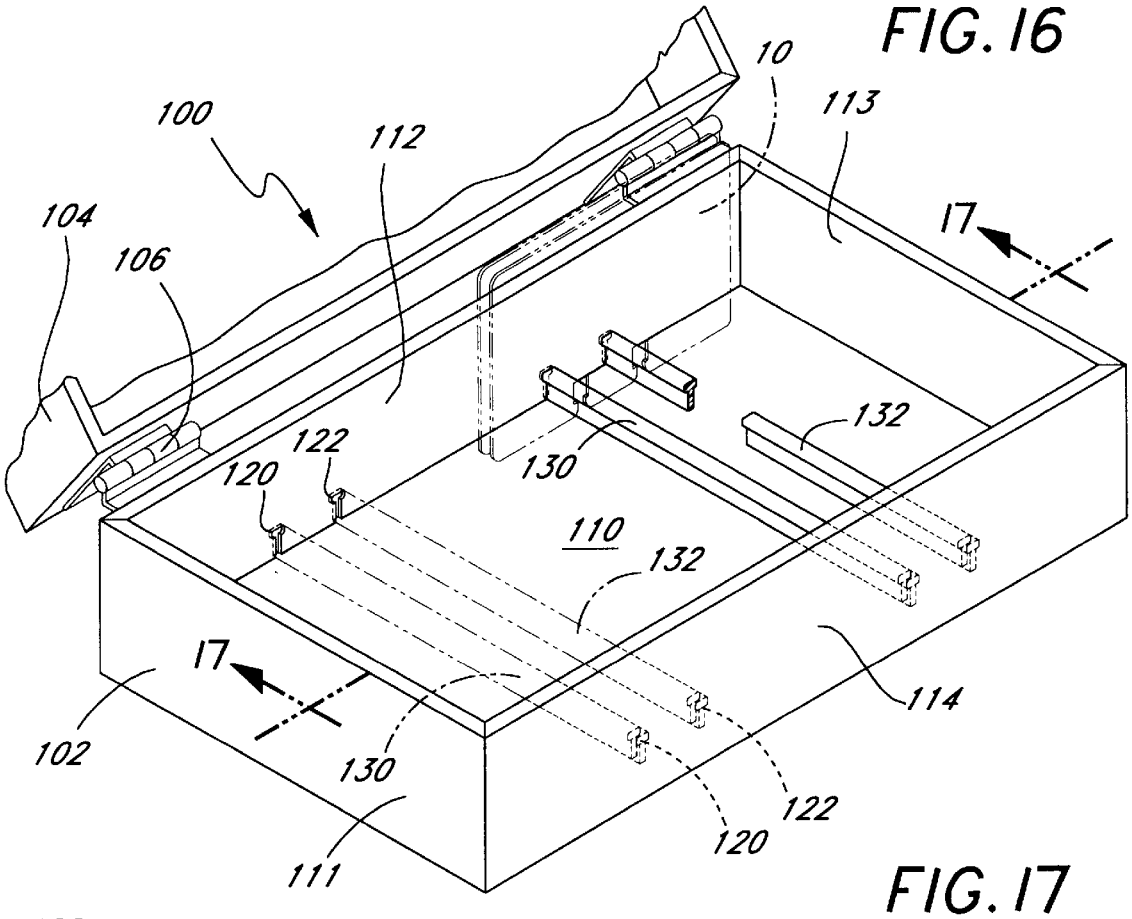
FIG. 16 is a fragmentary perspective view of a box-type mounting device used to organize the business card holders alphabetically.
Figure 17:
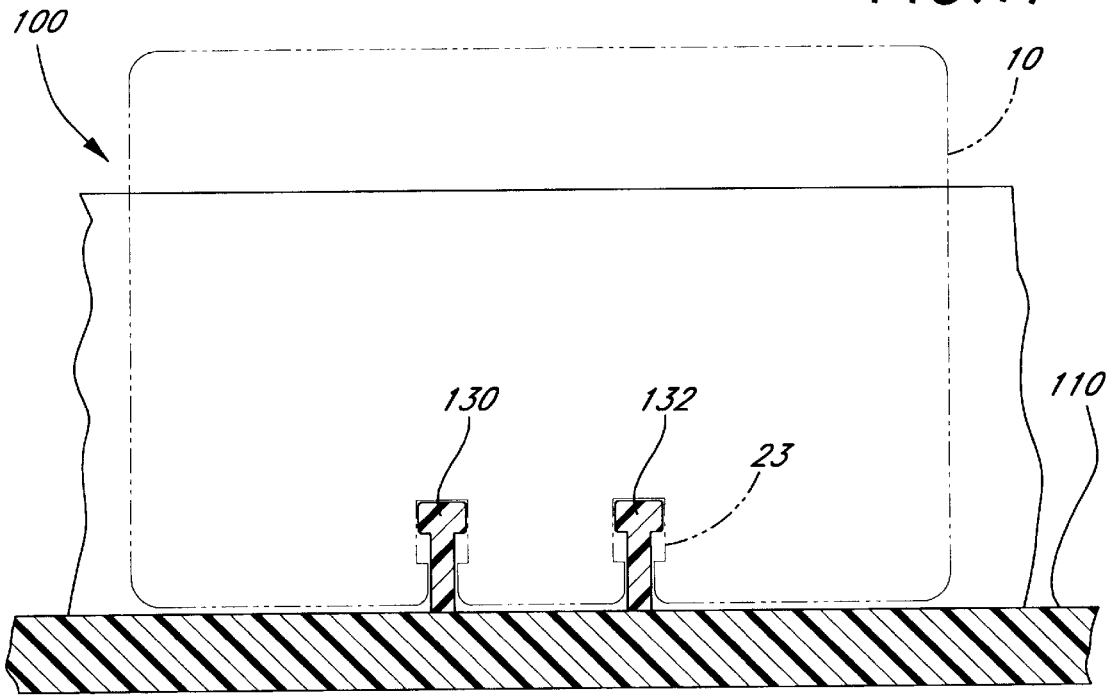
FIG. 17 FIG. 17 is a cross-sectional view taken along line 17—17 of FIG. 16.

After leaving the debossing station 44, the sheet material 12*a* is then advanced to the perimeter forming station 46 which forms the overall rectangular shape of the holder 10, including the mounting cutouts 23 for seating the holder 10 in a storage and retrieval system such as, for example, the system 100 depicted in FIGS. 16 and 17. The perimeter forming station 46 includes a conventional rotary die 79 having a pair of rollers 80 and 82 which are moved into engagement (shown in phantom) during formation of the holder 10. The upper roller 80 has a pair of die blades 84 and 86 seated on the surface of this roller which cut through the sheet material 12*a* as it moves through the nip of the rollers to form the overall outer configuration of the holder 10. The bordering web of waste material 12*b* is separated from the holders which are stacked on a receiving conveyor as the bordering web is wound up on a pick up roller 88.

Figure 15:
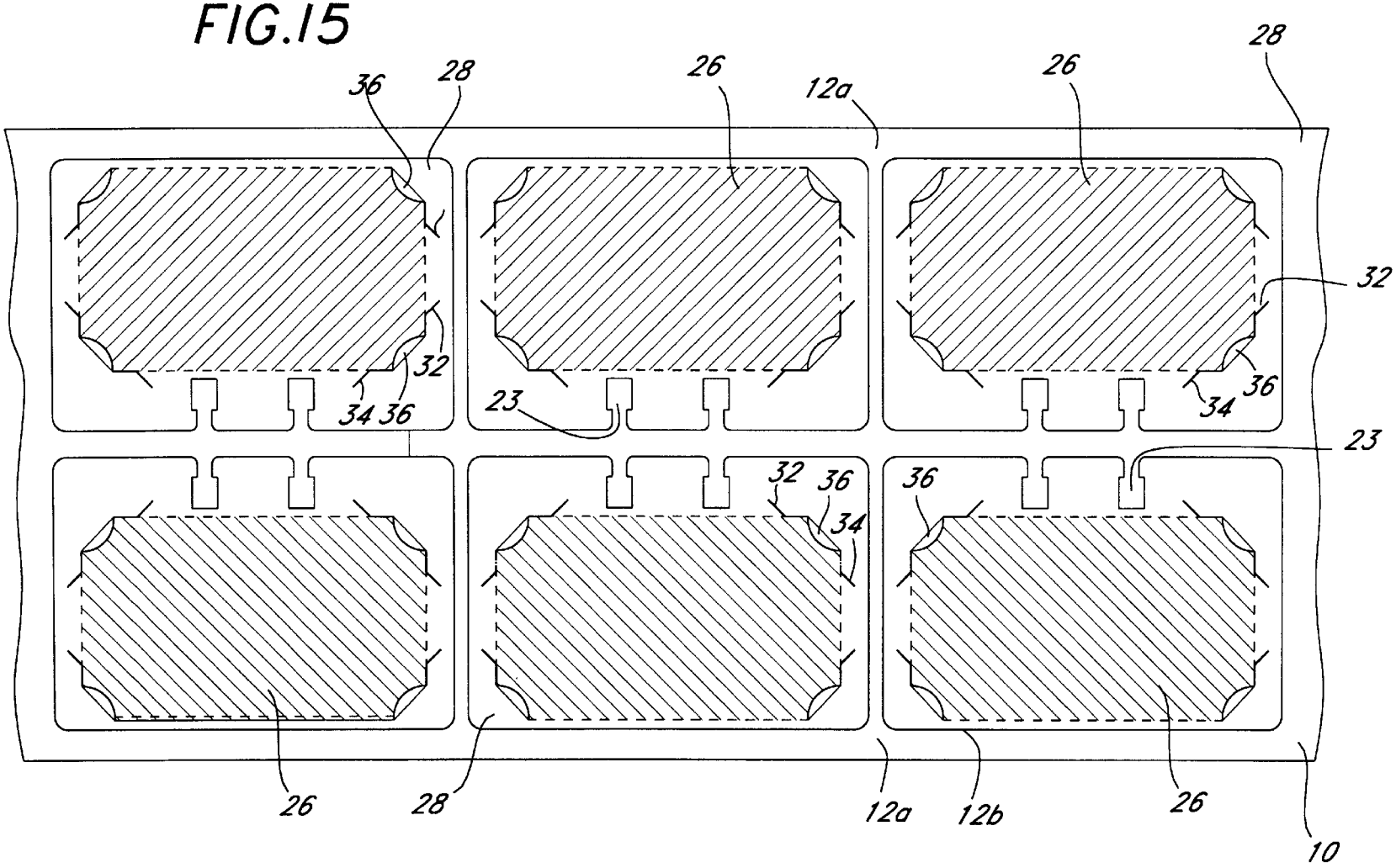
FIG. 15 is a plan view of the lay out on a continuous web of sheet material of the business card holder to be formed from the web.

The process thus described shows the use of rotary dies that produce two holders 10 with each revolution of the dies 54, 70, and 79. FIG. 15 shows a layout where rotary dies are modified to produce six holders with each revolution of such dies. These rotary dies are designed, for example, to provide the slits 32 and 34 that extend outward from the holes 36. Even larger rotary dies with different configurations could be designed to produce more than six holders with each revolution of the dies.

As shown in FIGS. 16 and 17, a storage and retrieval system 100 in the form of a box 102 with a coyer 104 is used to store assemblies of a business card and holder 10. Preferably, the box 102 and cover 104 are made from several pieces of wood. The cover 104 is attached by a hinge 106 to the the box 102. The box has a floor 110 as a separate piece and four sides 111, 112, 113, and 114 which are attached to each other in a conventional manner. The opposed long sides 112 and 114 have aligned pairs of grooved sections 120 and 122 substantially having the same cross-sectional configuration as the standard mounting cutouts 23 of the holder 10. There are pairs of substantially straight guides rails 130 and 132 along the floor 110 to which the holders 10 are removably attached. These guide rails 130 and 132 also have substantially the same cross-sectional configuration as the standard mounting cutouts 23.

The grooved sections 120 and 122 are along the lower edge of these sides 112 and 114 and aligned with each other. They do not go through the sides 112 and 114, but only extend part way into these sides. Thus, when the sides 111–114 are assembled, the two pairs of guide rails 130 and 132 are inserted into their corresponding grooved sections 120 and 122 for ease of assembly of the separate components making up the box. The guide rails 130 and 132 are adjacent the floor 110, and may be tilted, for example, tilted rearward, so that the forward ends of the rails adjacent the side 112 are slightly lower than the forward ends adjacent the side 114. This assists the assemblies of a business card and holder 10 in assuming a slightly angular relationship, slanting or tilting backwards toward the hinges 106. FIG. 18 depicts the use of a dowl rod 150 as a guide rail. The dowl rod 150 has a circular cross-sectional configuration and it provides a simple and inexpensive mounting site for the card holder 10, with the cutout 23 riding along the dowl rod. The rod 150 may be made of metal or wood.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention;

What is claimed is:

1. A method for storing and retrieving business cards, comprising the steps of:

(a) providing a card storage and retrieval system including a mounting device with at least one guide rail to which a business card holder is removably attached, (b) providing a business card holder for mounting thereon a single business card, said business card holder comprising a generally rectangular sheet having outside dimensions greater than the business card;

a predetermined location on the sheet where the business card is to be held on the sheet, said location having openings for inserting corners of the business card;

a marginal frame at least partially surrounding said location; and at least one mounting cutout in the sheet for attaching the card holder to the guide rail of the card storage and retrieval system, (c) removably mounting the business card to the business card holder by inserting corners of the business card in the openings in the holder to position the business card at said location to provide an assembly of the business card and holder, and (d) attaching the assembly of the business card and holder to the guide rail by aligning the mounting cutout with the rail and pushing the holder against the rail, said business card holder being manufactured from a web of sheet material using a rotary die to form said holder by continuously feeding the web through said die.

2. The method of claim 1 where the marginal frame surrounding the rectangular area is printed upon during manufacture of the holder.

3. The method of claim 1 where there is a slit extending from at least some of the holes, said slit having a predetermined shape and orientation to allow business cards larger than the standard business card to be mounted to the card holder.

4. The method of claim 1 where the mounting device is made form a plurality of wood pieces connected together to form a box with opposed side walls that are generally parallel, with at least one pair of parallel guide rails extending between said side walls, the guide rails each having opposed ends which are inserted into cut-a-way portions in the side walls during assembly of the walls, said guide rails being made of a polymeric material.

* * * * *